United States Patent [19]

Block

[11] Patent Number: 4,969,299

[45] Date of Patent: Nov. 13, 1990

[54] FLAP WHEEL

[76] Inventor: Aleck Block, 800 Warner Ave., Los Angeles, Calif. 90024

[21] Appl. No.: 296,534

[22] Filed: Jan. 12, 1989

[51] Int. Cl.[5] ..... B24B 9/02

[52] U.S. Cl. ..... 51/330; 51/334; 51/337; 51/401

[58] Field of Search ..... 51/330, 331, 332, 334, 51/336, 337, 394, 395, 401, 402, 407

[56] References Cited

U.S. PATENT DOCUMENTS

| | | | |
|---|---|---|---|
| 3,053,021 | 9/1962 | Block | 51/337 |
| 3,141,269 | 7/1964 | Block | 51/337 |
| 3,548,551 | 12/1970 | Block | 51/337 |
| 3,600,861 | 8/1971 | Haywood | 51/334 |
| 3,678,633 | 7/1972 | Block | 51/337 |
| 3,872,630 | 3/1975 | Ali | 51/334 |
| 4,275,529 | 6/1981 | Teetzel et al. | 51/334 |
| 4,872,292 | 10/1989 | Block | 51/407 X |

*Primary Examiner*—D. S. Meislin
*Assistant Examiner*—M. Rachuba
*Attorney, Agent, or Firm*—Ellsworth R. Roston; Charles H. Schwartz

[57] ABSTRACT

Abrasive particles are adhered to a first surface of a backing member to define an abrasive-coated flap. The abrasive particles are removed from support portions of the flaps in a pack but only substantially at the positions on the flaps where the flaps in the pack are tightly compressed and supported by retaining members. In addition to being compressed at the support positions, the flaps are compressed at positions interior to the support positions but to a lesser degree than at the support portions because the abrasive material remains on the interior portions of the flaps. An adhesive may be applied to the flaps at the support positions and the interior positions to retain the flaps in fixed position relative to one another. Abrasive strips having compressible properties (e.g. "Scotch Brite" material manufactured by 3M) may be disposed between adjacent abrasive-coated flaps. In some applications, the abrasive particles may be removed from the support portions and the interior portions of some of the abrasive-coated flaps in a pack to assure that an optimum number of flaps may be provided in each pack while still allowing the packs to be disposed in an annular array in a wheel without physical interference between adjacent packs. Wheels constructed from the packs described above are advantageous in that they have a considerably greater number of flaps than the corresponding wheels of the prior art. They are stronger in construction and safer in operation than the corresponding wheels of the prior art.

25 Claims, 3 Drawing Sheets

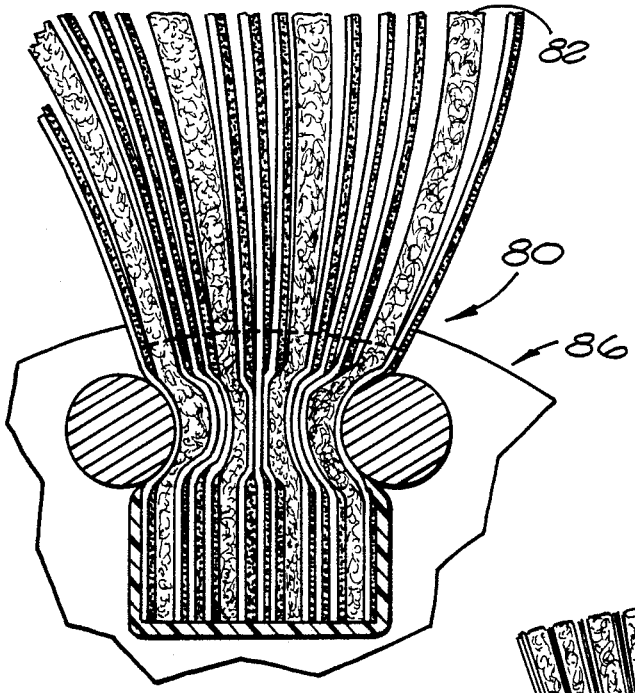
FIG. 6
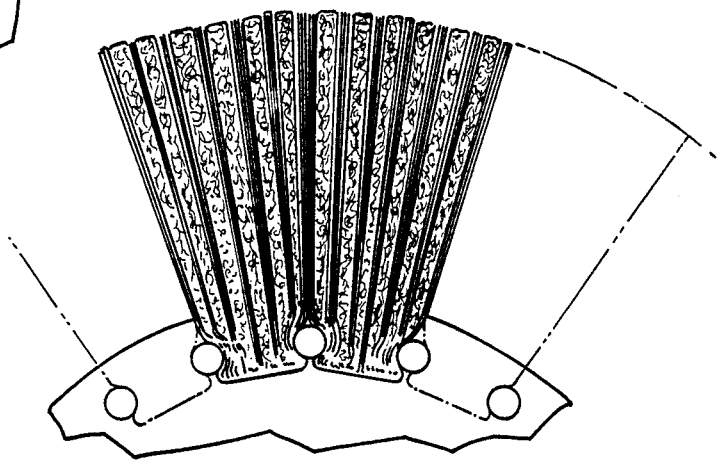
FIG. 7
FIG. 8
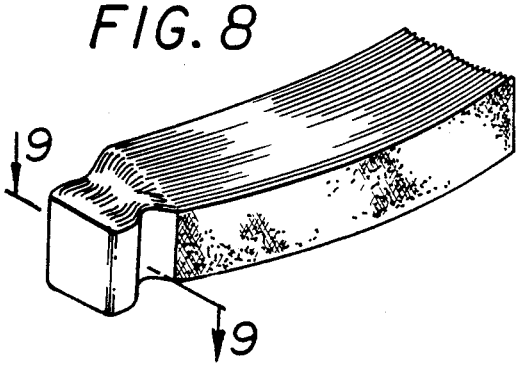
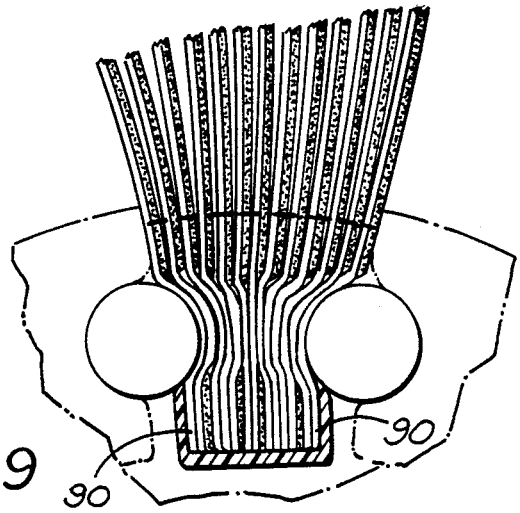
FIG. 9

FLAP WHEEL

This invention relates to abrasive wheels. The invention particularly pertains to a pack-type abrasive flap wheel in which a considerably increased number of abrasive flaps can be provided in a wheel of any particular size, and in a more secure condition, than in the prior art to enhance the abrasive action of the flap wheel on a workpiece.

Abrasive flap wheels are used to provide a resilient, but positive, abrading action on a workpiece. The pack-type abrasive flap wheels are formed from a plurality of abrasive flaps each including a backing member and abrasive particles adhered to the backing member. The flaps are generally disposed in packs in an annular array to form a wheel which is supported by a rotary member such as a hub of generally cylindrical form. The wheel is rotated to obtain a rotation of the flaps past a workpiece. As the individual flaps move past the workpiece, the flaps in such packs impinge on the workpiece and provide an abrading action on the workpiece.

The pack-type abrasive flap wheels now in use have certain significant disadvantages. One disadvantage of the wheels formed from packs of flaps is that the wheels can contain only a relatively limited number of flaps. This results in a correspondingly limited rate of removal of material from a workpiece during the wheel operation, and it also results in a relatively limited life of the wheel. Another disadvantage is that, when the flaps are worn down to short lengths, they lose much of their flexibility. This, together with the relatively wide spacing of the packs, causes an intermittent hammering action of the packs against the workpiece, sharply reducing the wheel's ability to produce a smooth and uniform finish.

A further disadvantage is that the pack-type abrasive wheels of the prior art (with the exception of the article of Block U.S. Pat. No. 3,053,021) have extra members attached to the radially inner ends of the packs to provide means to retain the packs in the periphery of the hub. These members and/or the means by which these members are fastened to the pack are subject to high centrifugal strain, vibration and fatigue during the operation of the wheel and as a consequence sometimes fail, permitting flaps or entire packs to explode from the hub at high speeds, seriously endangering the operator or persons positioned near the wheel.

In the case of the article of Block U.S. Pat. No. 3,053,021, the pack is configured so that the anchored portion of the pack is an integral part of the pack itself, the anchored portion being an uncompressed butt end of the pack, while the support portion of the pack is compressed. However, the thickness of the abrasive-coated flaps of this pack is such that a severely limited number of flaps can be contained in the support portion, while the butt or interior portion is so thick, in section, that a relatively severely limited number of packs can be fixed in the periphery of a hub of a certain diameter, further reducing the total number of flaps that can be contained in a wheel.

Wheels of this last described configuration, as well as all wheels where the butt ends of the packs are socketed in the periphery of the hub, have not been successful on the market, and are not presently marketed, by reason of the above-described deficiencies. Wheels of the Belanger U.S. Pat. No. 4,055,919, in which the pack is anchored outside the periphery of the hub by means of an intervening member, have enjoyed considerable success in the market, but are not entirely satisfactory because of the exposure of the intervening member. Furthermore, the means by which the pack is attached to the member are subject to continual stress as described above and are liable to failure, as are other wheels of this extended anchor type.

A considerable effort has been made in the past, and significant amounts of money have been expended, to provide an abrasive wheel which overcomes the above difficulties. In spite of such efforts and such expenditures of money, the problems discussed above still persist. These problems have been aggravated because a substantial amount of time has had to be expended in removing the worn abrasive element from an arbor and in establishing a new abrasive element on the arbor.

This invention relates to an apparatus for overcoming the above problems. The invention provides a wheel in which the number of flaps, for a wheel of any particular diameter and flap length, may be increased by a factor as high as seventy-five percent (75%) above the number of flaps now in use in wheels of the same particular diameter. This means that substantially more abrasion is obtained per wheel revolution. Furthermore, the packs cannot be lost from the wheels of this invention during the operation of such wheels. The packs may also positioned closer to one another on the hub, eliminating gaps and providing for smoother operation for the entire life of the wheel.

In one embodiment of the invention, abrasive particles are adhered to a first surface of a backing member to define a flap. These particles are removed from support portions of flaps in a pack at the positions where the packs are tightly compressed and are supported by retaining members in the hub. In addition to being compressed at the support portions, the packs of flaps are compressed at positions interior to the support portions but cannot be reduced to as small a thickness as at the support portions because the abrasive material remains at the interior portions of the pack. An adhesive may be applied to the flaps at the support portions and the interior positions to retain the flaps in fixed position relative to one another.

As an example of the very substantial reduction in thickness of the flaps obtained by removal of grain at the support areas of the abrasive-coated flaps of the present invention, the standard thickness of industrial weight abrasive-coasted cloth as supplied by all manufacturers for use in this type of end product is approximately 0.011" thick. When coated with a medium coarse grain such as #80, a popular grade, the total thickness of the flap becomes approximately 0.034" thick. It can be seen, therefore, that removal of the grain will reduce the thickness of the flap by approximately 67%; this reduction is greater in coarser grit material and decreases to an approximate 45% reduction in finer grits which constitute a thinner coating. It is possible, therefore, as an average, to double the number of flaps in a pack for a wheel of the present invention as against corresponding wheels of prior art.

Wheels constructed from the packs described above are advantageous in that they have a considerably greater number of flaps than the corresponding wheels of the prior art. Also, the configuration of the packs constitutes an anchoring means integral with the packs, precluding the possibility of failure of separate anchoring means as in wheels of the prior art, and are thus safer to operate. Furthermore, since the gaps between packs are greatly reduced, the wheels can be used when worn down to a smaller diameter without developing a hammering action on the workpiece, further contributing to the extended effective life of the wheel.

IN THE DRAWINGS

FIG. 6 is an enlarged fragmentary schematic sectional view in elevation, similar to that shown in FIG. 5, of another embodiment of a pack of this invention and illustrates how the pack is retained on a hub;

FIG. 7 is as fragmentary schematic elevational view of a wheel incorporating the packs of FIG. 6;

FIG. 8 is a schematic perspective view of a pack constituting a modification of the embodiment shown in FIGS. 3-5A; and FIG. 9 is a sectional view taken substantially on the line 9—9 of FIG. 8 and illustrates the pack of FIG. 8 in further detail and the retention of the pack in a wheel.

Figure 1:
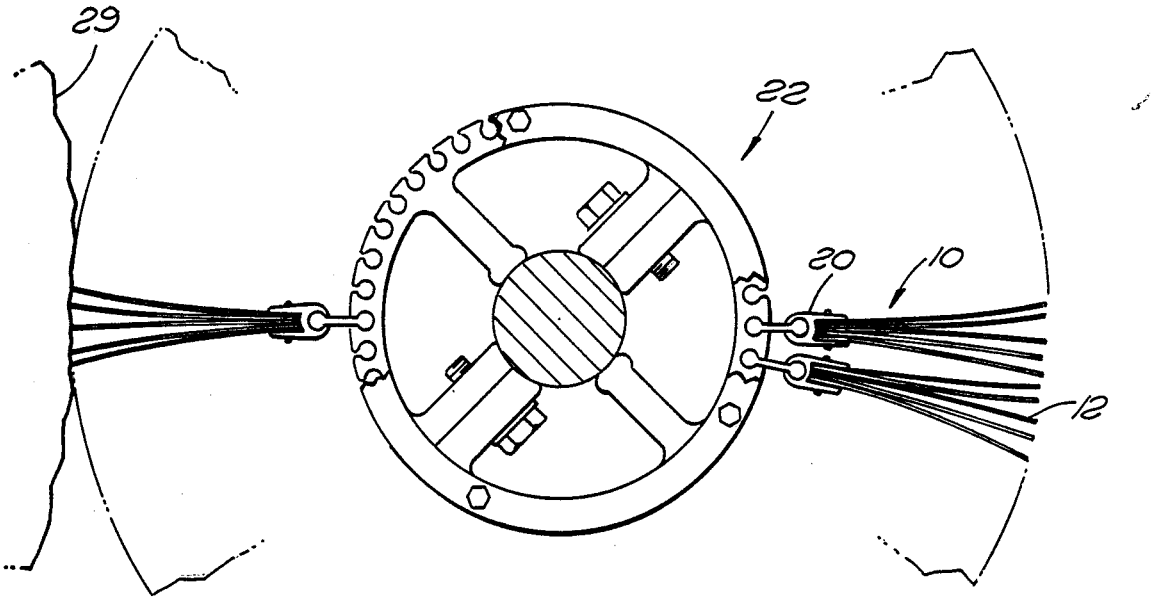
FIG. 1 PRIOR ART
FIG. 1 is a fragmentary schematic elevational view of one embodiment of a wheel having a segmental annular array of packs of abrasive flaps, this wheel being included in the prior art.
Figure 1A:
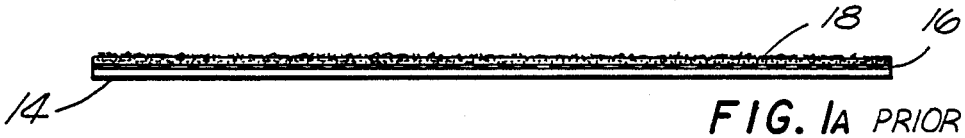
FIG. 1A PRIOR ART
FIG. 1A is an enlarged elevational view of one of the flaps shown in the packs of FIG. 1.

FIG. 1 illustrates on a fragmentary, schematic basis a portion of an abrasive array or pack, generally indicated at 10, of the prior art. The abrasive array or pack 10 includes a plurality of abrasive flaps 12 each extending outwardly in a generally radial direction. Each of the flaps 12 is formed from a backing member 14 made from a suitable material such as a cloth. Each of the flaps 12 is provided with a layer of an adhesive 16 on a first surface of the backing member. The adhesive may be any suitable material such as a phenolic resin. Abrasive particles 18 are adhered to the adhesive. When the flaps 12 are assembled to form the abrasive pack 10, the abrasive particles on the first surface of each abrasive flap 12 are contiguous to the second surface of the contiguous flaps.

The flaps 12 are preferably super-imposed in a stacked relationship in the pack 10 and are held in this array by a member such as that illustrated at 20 in FIG. 1. A plurality of such packs may be disposed in an annular configuration to define a wheel such as that generally indicated at 22 in FIG. 1. Alternatively, the packs 10 of the prior art may be held in a pocket 24 in a hub 26 as by spacers 28 attached to the end flaps of the pack at the inner ends of the flaps, as shown in FIG. 2.

Figure 2:
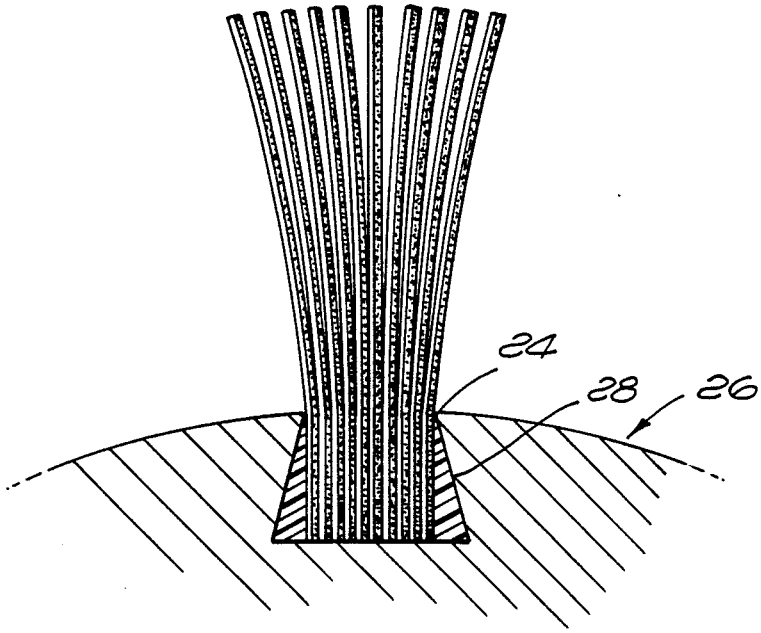
FIG. 2 PRIOR ART
FIG. 2 is a fragmentary schematic sectional view in elevation of another embodiment of a segmental pack of abrasive flaps of the prior art, the pack being shown as being disposed on a wheel.

The abrasive wheels of the prior art such as the wheel 22 of FIG. 1 and the wheel 26 of FIG. 2 have certain inherent disadvantages. One disadvantage is that the number of flaps capable of being disposed in each of the packs 10 is limited by the thickness of the flaps. This, in turn, limits the total number of flaps which may be disposed on a hub of a given diameter to form a wheel, thus limiting the abrasion of the wheel per revolution. It also limits the life of the pack 10 when disposed on the wheel. Since the time for setting up the wheel to engage the workpiece is a significant factor in determining the cost of buying and using the wheel, the limited life of the wheel is a deterrent to using the wheel for abrading the workpiece in comparison to other apparatus and techniques for abrading the workpiece.

Figure 3:
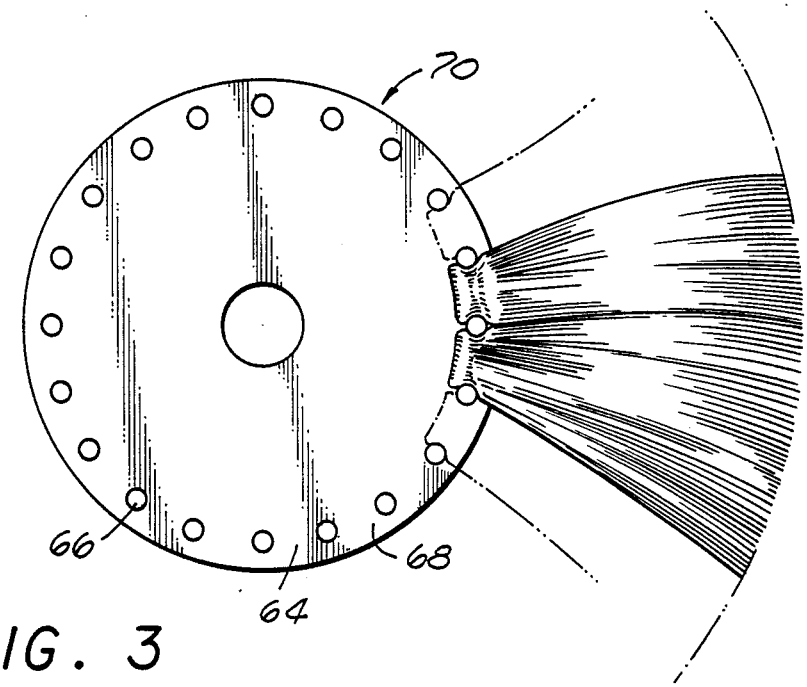
FIG. 3 is a fragmentary schematic elevational view of a wheel of this invention, the wheel having a segmental annular array of packs of abrasive flaps constituting one embodiment of the invention.
Figure 5A:
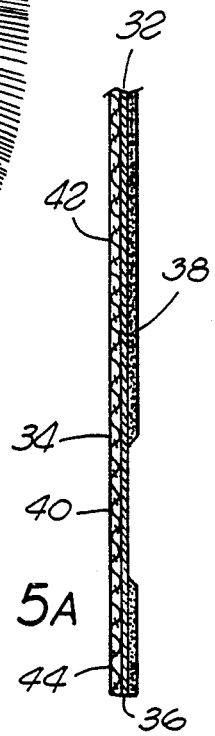
FIG. 5A is an enlarged schematic elevational view of one of the flaps in the packs of this invention.

FIG. 3 illustrates on a magnified, fragmentary, schematic basis an array or pack, generally indicated at 30, of this invention. The pack 30 includes a plurality of abrasive flaps 32 (FIG. 5A) each formed from a backing member 34 which is constructed in a manner similar to the backing member 14 of the prior art. An adhesive 36 such as an epoxy is applied to a first surface of each backing member 34 in a manner similar to that of the prior art, and abrasive particles 38 are adhered to the adhesive 36 in a manner similar to that of the prior art.

Each of the flaps 32 (FIG. 5A) may be considered to have a support portion 40, a working portion 42 and a portion 44 interior to the support portion 40. The support portion 40 of each flap 32 may be considered to constitute that portion in which the flaps are attached to a wheel. The working portion 42 may be considered to constitute that portion which is capable of engaging the workpiece 29 to provide an abrasive action on the workpiece. The interior portion 44 is closer to the center of the wheel than the support portion 40. In the embodiment of this invention, the abrasive particles 38 are removed from the support portion 40 of each abrasive flap 32. The abrasive particles are retained in the working portion 42 and the interior portion 44 of each flap 32.

In removing the abrasive particles 38 from the support portion 40 of each flap 32, care should preferably be taken that the backing member 34 on the flap is not weakened. In this way, the flaps 32 will be retained in the wheel 30 without tearing from the wheel even when great centrifugal forces are exerted by the workpiece 29 on the flaps. Preferably in most embodiments, a portion of the adhesive 36 may be retained on the support portion 40 of each backing member 34 when the abrasive particles 38 are removed from the support portion of the backing member. It will be appreciated, however, that all of the adhesive 32 may be removed from the support surface 40 of each flap 32 without departing from the scope of this invention.

After the abrasive particles 38 have been removed from the support portion 40 of each backing member 34, the backing members are stacked to form the pack 30. In such pack, the abrasive particles on the first surface of each flap face the second surface of the contiguous flap. The support surfaces 40 of the flaps 32 at the inner ends of the working portion are then tightly compressed to minimize the space occupied by the flaps. The interior portions 44 are also compressed so that there will be no interference between adjacent packs when the packs are disposed on a wheel. However, the flaps 32 are not as tightly compressed at the interior portions 44 as at the support portions 40 because the interior portions have the abrasive particles 38.

By reason of the reduced thickness of the flaps 32 at the support portions 40 and the compression of the flaps at the support portions and the interior portions, the number of flaps in a given space such as a sector can be increased by as much as seventy-five percent (75%) in comparison to the number of flaps occupying such space in the corresponding prior art.

To retain the flaps 32 in a fixed relationship relative to one another as defined in the previous paragraph, an adhesive 50 is disposed on the support portions 40 and the interior portions 44 of the flaps. The adhesive 50 flows between the flaps in the regions of the support portions 40 and the interior portions 44 to retain the flaps in a fixed relationship. The adhesive 50 is compatible with the adhesive 36 and with the material of the backing members 34 so as to bond the backing members together. Preferably the adhesive 50 is an epoxy. The adhesive 50 may also be disposed at the inner ends of the interior portions 44 of the flaps 32, as indicated at 52 in FIG. 3, so as to enhance the bond between the different abrasive flaps in the pack.

Figure 4:
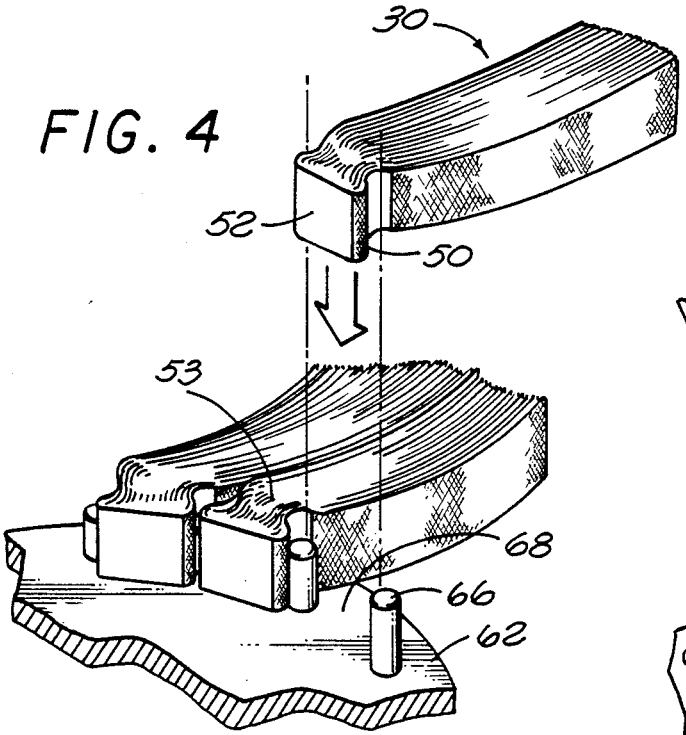
FIG. 4 is a fragmentary schematic perspective view of the embodiment of the wheel shown in FIG. 3 and illustrates on an exploded basis how one of the packs is inserted into the wheel for retention by the wheel.

FIGS. 3 and 4 illustrate one embodiment in which the features of this invention may be incorporated. In the embodiment shown in FIGS. 3 and 4, the packs 30 are adapted to be supported by a hub 62 for rotation with the hub. The rotary member may be formed in part by a pair of spaced annular plates 64. The support for the packs 30 is provided by retainers 66 integral with, or attached to, one of the plates 64 at spaced positions in an annular direction around such plate. The retainers 66 define restricted openings 68 to confine the support portions 40 of the flaps 32 within such restricted openings. The packs 30 are retained in fixed position by the retainer 66 because the packs are narrower at the support portions 40 than at the working portions 42 and the interior portions 44.

The apparatus constituting this invention has other advantages of some importance in comparison to the prior art. For example, a pack-type wheel (such as that indicated generally at 70 in FIG. 3) incorporating the packs of this invention is considerably more balanced than the unitary wheels of the prior art, in which all of the flaps of the wheel are adhered to one another at their radially inner end margins to form a discrete annular array, comprising a much higher density of flaps than the pack-type wheels of the prior art. However, this unitary design also often makes it impossible to compress the flaps together with a uniform density and to distribute the adhesive, which is of considerable weight, uniformly between the radially inner margins of the flaps. This often results in a wheel which is seriously out of balance and which in operation produces a chattering effect on the workpiece 29, affecting the finish adversely. Sometimes, if the imbalance is extreme, the wheel explodes.

The wheel 70 of the present invention attains the virtue of flap density of the unitary-type wheels while also maintaining the fine balance inherent in the pack-type wheels. The enhanced balance in the wheel 70 of this invention results from the disposition of a precise number of leaves in each pack while the high flap density in the packs achieve a high rate of abrasion. The close spacing of the packs on the periphery of the wheel produces a smoother abrasive action on the workpiece 29 than in the pack-type wheels of the prior art.

In the wheels incorporating the packs of this invention, there is substantially no separation between adjacent packs because of the absence of members such as the member 20 in FIG. 1 and spacers such as the spacers 28 in FIG. 2. The apparatus constituting this invention has another important advantage over other pack-type flap wheels in that the greatly reduced thickness of the support section of the packs causes the relatively much thicker sections of the packs immediately outward of the support sections to belly out so that the outer flaps of each pack lie adjacent to the flaps of the neighboring packs 53 of FIG. 4. This constitutes an uninterrupted total array of flaps not only at the circumference of a wheel as just put into operation, but also at its reduced diameters as it is wearing down to its minimum working diameter. This quality is significantly superior to pack-type flap wheels of prior art in which the mounting system for the packs necessitates a considerable gap between packs at correspondingly reduced diameters, these gaps causing the wheel to chatter, reducing the operator's controllability of the workpiece and the quality of the finish produced by the wheel.

The apparatus of this invention also has other advantages of some importance. This results from the fact that there are no abrasive particles on the flaps 32 at the positions where the flaps abut the retainers 66 in the wheel 70. As a result, there is no abrading or macerating action of the particles 38 on each flap 32 against the backing member 34 on the adjacent flap. Such abrading or macerating action is undesirable since it tends to weaken or lacerate the flaps, thereby causing the flaps to become separated occasionally from the packs. Any such flap separations are undesirable because the flaps travel at high speeds when the flaps are being applied against the workpiece 29. At high speeds, the flaps act as projectiles which can injure the operator or persons located nearby.

There are also other important advantages in the packs of this invention. This results from the removal of the abrasive particles 38 from the support portions 40 of the flaps 32 at positions near the inner ends of the flaps. For example, the support portions 40 may have a length (in the radial direction of the wheel) of about three eighths of an inch ($\frac{3}{8}''$) and the interior portions 44 may have a length of about one eighth of an inch ($\frac{1}{8}''$). The length of the support portions 40 (constituting the portions where the abrasive particles are removed from the flaps) is sufficient to insure that the support portions extend around the retainers 66 in a progressive arc without any contact of abrasive particles with the retainers 66 and without any abrading or macerating action of the abrasive particles against adjacent flaps in this arc.

The length of the interior portions 44 of the flaps 32 is sufficient to assure that the interior portions will act to retain the packs between adjacent pairs of the retainers 66 even while the wheel is rotating at high speeds and is being applied with a great force against the workpiece 29. However, the lengths of the interior portions 44 of the flaps 12 is sufficiently small so that the interior portions 44 of the flaps in the adjacent packs on the wheel will not interfere physically with one another. This is illustrated in FIG. 3 and 4. This assures that the packs can be closely spaced on the wheel.

Since the flaps 32 are not reduced by compression to as thin a section at the interior portions 44 as at the support portions 40, the flaps are fixedly maintained in position by the retainers 66 as the wheel rotates. Furthermore, the compression of the interior portions 44 offers another advantage since they provide for a clearance between adjacent packs 30 of flaps at the inner ends of the flaps when the packs are positioned on the wheel 70.

Figure 5:
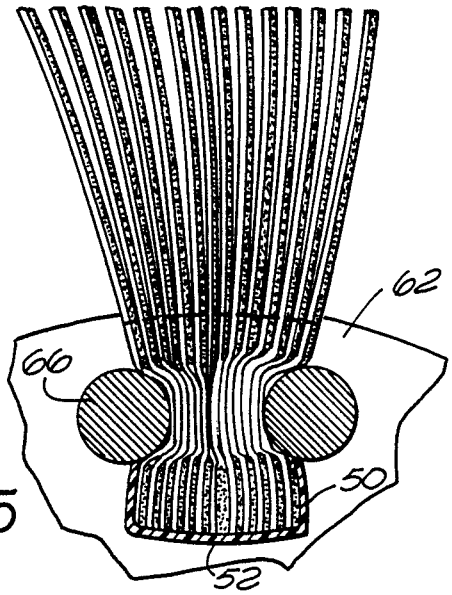
FIG. 5 is a fragmentary schematic sectional view, in elevation, illustrating the retention of a pack of this invention by retainers in the wheel shown in FIGS. 3 and 4.

FIGS. 6 and 7 illustrate another embodiment of a pack, generally indicated at 80, in which the features of this invention may be incorporated. This pack 80 is similar to the pack shown in FIGS. 3–5 and described above except that flaps 82 made from a suitable material such as that designated as "Scotch Brite" by the Minnesota and Mining Company ("3M") may be interposed between the flaps 32. The flaps 82 may be made from a material having abrasive and compressible properties, the "Scotch Brite" material of 3M being a good example of this. The flaps 82 may be disposed between every adjacent pair of the flaps 32 or they may be disposed after every second (2d) flap 32 or after every third (3d) flap 32 or any other alternate number of flaps.

The packs 80 may be disposed in an abrasive wheel such as that generally indicated at 86 in FIGS. 6 and 7. The embodiment of FIGS. 6 and 7 is particularly advantageous when used in wheels having flaps with finely grained particles 38. Such wheels are often used for high, or fine, polishing of the workpiece 29.

As will be appreciated, the embodiments shown in FIGS. 3–5A and in FIGS. 6 and 7 and discussed above are somewhat similar to the embodiments disclosed and claimed in co-pending application Ser. No. 210,006 (now U.S. Pat. No. 4,872,292) filed by me on June 22, 1988, for a "Flap Wheel". However, in this application, the abrasive particles 38 are removed from the flaps 32 only at the support portions 40 and not at the interior portions 44. In co-pending application Ser. No. 210,006, the abrasive particles are removed from the flaps at the support portions and the interior portions of the flaps.

With wheels having flaps of relatively coarse grain, it may be desirable to remove the abrasive particles at the support portions 40 and the interior portions 44 of some of the flaps 32 in each of the packs 30. The reason for doing this is to narrow the thickness of each of the packs at the interior ends of the packs so that a maximum number of flaps can be disposed in each pack without having a physical interference between the successive pairs of packs on the wheel. This is illustrated in the embodiment shown in FIGS. 8 and 9 where the abrasive particles are removed from the support portions 40 and the interior portions 44 in such flaps as flaps 90. For example, the abrasive particles 38 may be removed from every fourth flap or every fifth flap in the abrasive pack. By providing the arrangement shown in FIGS. 8 and 9, the number of flaps in a wheel can be increased above the number provided by the embodiment shown in FIGS. 3–5. This causes the number of flaps in a wheel incorporating the packs shown in FIGS. 8 and 9 to rival the number of flaps in a unitary wheel of the same size, particularly when flaps with coarsely grained particles are used.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

I claim:

1. In combination for use in an array for engaging a workpiece, a plurality of abrasive flaps each having first and second parallel surfaces and including a backing member and abrasive particles on the first surface of the backing member, each of the abrasive flaps having a particular width, each of the abrasive flaps having a working portion, a support portion and an interior portion extending from the support portion to the end of the flap opposite the working portion, the abrasive particles being removed from the flaps only at the support portions of the flaps along the full widths of the support portions, the abrasive flaps being compressed against one another at the support portions of the flaps and at the interior portions of the flaps along the full widths of such support portions and interior portions, and an adhesive material disposed between the flaps at the support portions and the interior portions of the flaps with the abrasive flaps tightly compressed against one another at the support portions of the flaps along the full widths and at the interior portions of the flaps along the full widths.

2. In a combination as set forth in claim 1 wherein the adhesive material also covers the external surfaces of the support portions and the interior portions of the flaps.

3. In combination for use in any array for engaging a workpiece, a plurality of abrasive flaps each having first and second parallel surfaces and including a backing member and abrasive particles on the first surface of the backing member, each of the abrasive flaps having a working portion, a support portion and an interior portion extending from the support portion to the end of the flap opposite the working portion, the abrasive particles being removed from the flaps in the packs only at the support portions of the flaps, the abrasive flaps being compressed against one another at the support portions of the flaps and at the interior portions of the flaps, and an adhesive material disposed between the flaps at the support portions and the interior portions of the flaps with the abrasive flaps tightly compressed against one another at the support portions of the flaps and at the interior portions of the flaps, the abrasive particles on each abrasive flap being attached by an adherent material to the support portion of the flap and at least a portion of the adherent material remaining on the support portion of the flap after removal of the abrasive particles from the flap and additional adherent material being provided between the flaps and being adhered to the adherent material remaining on the flaps after the removal of the abrasive particles from the flaps.

4. In a combination as set forth in claim 1 wherein adhesive material fills the spacing between the adjacent flaps at the support and interior portions of the flaps.

5. In a combination as set forth in claim 4, a wheel including retaining means disposed at spaced positions on the wheel and supporting the support portions of the flaps to facilitate the retention of the flaps in a compressed relationship.

6. In combination for engaging a workpiece, a plurality of abrasive packs each formed from a plurality of abrasive flaps, each of the abrasive flaps having a particular width, each of the abrasive flaps in each of the abrasive packs including a backing member having first and second opposite surfaces and having a working portion, a support portion and an interior portion extending from the support portion in a direction opposite to the working portion and having abrasive particles adhered to the working portion and the interior portion and having abrasive particles removed only from the backing member at the support portion along the full width of the support portion, the support portions and the interior portions of the abrasive flaps in each array being tightly compressed against one another along the full width of the flaps and being adhered to one another in the tightly compressed configuration, and means for retaining the packs in an annular disposition for rotation relative to the workpiece.

7. In a combination as set forth in claim 6, means coupled to the retaining means for providing for rotation of the packs and the retaining means.

8. In a combination as set forth in claim 7, the retaining means including end plates and means for retaining the end plates against the flaps to retain the flaps in the annular relationship.

9. In a combination as set forth in claim 7, retainer means for each pack, the retainer means constituting members disposed between the end plates at the positions of the support portions of such flaps to facilitate the maintenance of the support portions of such flaps in the tightly compressed relationship.

10. In a combination as set forth in claim 9, abrasive and compressive sheets of material being disposed between adjacent pairs of flaps in the plurality and being compressed at the positions of the support portions and the interior portions of the flaps in the plurality, the abrasive and compressive sheets of material being provided with the particular width and being compressed at the positions of the support portions and the interior portions along the full widths of such sheets.

11. In combination for use in an abrasive wheel for engaging a workpiece, a plurality of abrasive flaps disposed in a pack, each of the abrasive flaps having first and second surfaces disposed in relatively closely spaced and substantially parallel relationship to each other and each defined by a support portion near the inner end of the flap, a working portion at the outer end of the flap and an interior portion extending from the support portion at the end opposite the working portion and each further defined by a backing member and a first adhesive on the first surface of the backing member and by abrasive particles adhered to the first adhesive, the abrasive flaps having a particular width, the abrasive particles being removed only from the support portion of each flap along the full width of such flap, the support portions and interior portions of the flaps in the arrays being retained in a compressed relationship along the full widths of the flaps, and additional adhesive disposed between the support portions of the flaps and between the interior portions of the flaps to retain the support portions and interior portions of the abrasive flaps in the pack in the compressed relationship.

12. In a combination as set forth in claim 11, the working and interior portions of the flaps being longer than the support portions of the flaps.

13. In a combination as set forth in claim 11, flaps of material disposed between individual pairs of the flaps in the plurality and being compressed at the support portions of the flaps along the full widths of the flaps and being compressed at the interior portions of the flaps along the full widths of the flaps, the material of such flaps being abrasive and compressible.

14. A method of forming an abrasive array for providing an abrading action against a workpiece, including the following steps:

providing a plurality of abrasive flaps each having a backing member with first and second relatively closely spaced and substantially parallel surfaces and with an adhesive material on the first surface and with abrasive particles adhered to the adhesive material, each of the abrasive flaps having a support portion for holding the flaps in a slightly radially diverging relationship for action against the workpiece and having a working portion and an interior portion extending from the support portion in a direction opposite to the working portion, removing the abrasive particles only from the support portions of the abrasive flaps while retaining at least a portion of the adhesive on the first surface of the flaps at such support portions, disposing the flaps in a stacked relationship with the first surface of each flap abutting the second surface of the contiguous flap, and compressing the support and interior portions of the flaps, and applying an adhesive between the support portions of the flaps and between the interior portions of the flaps with the support and interior portions in the compressed relationship.

15. A method as set forth in claim 14, including the step of:

disposing retaining members in cooperative relationship with the flaps in the pack at the support portions of the flaps to assure that the flaps are retained in the tightly compressed relationship at the support portions.

16. A method as set forth in claim 14, including the steps of:

disposing flaps of a compressible and abrasive material between adjacent pairs of the flaps in the plurality before the flaps are compressed at the support portions and the interior portions of the flaps.

17. A method of forming an abrasive array for providing an abrasive action against a workpiece, including the steps of:

providing a plurality of abrasive flaps each including a backing member having first and second surfaces and each including adhesive material on the first surface and abrasive particles adhered to the adhesive material and each including a working portion at one end, a support portion near the opposite end and an interior portion at the opposite end, each of the abrasive flaps having a particular width, removing the abrasive particles only from the support portions of the backing members in the abrasive flaps along the full widths of the backing members, disposing the flaps in a stacked relationship with the second surface of each flap facing the first surface of the contiguous flap and with the support portions and the interior portions of the flaps in a compressed relationship along the full widths of the flaps, and disposing adhesive between the support portions of the flaps and between the interior portions of the flaps with the support portions and the interior portions of the flaps in the compressed relationship.

18. A method a set forth in claim 14, including the step of:

supporting the packs of the abrasive flaps on a rotary member to provide for an abrasive action of the flaps on the workpiece when the member is rotated.

19. A method as set forth in claim 18, wherein the packs are fixedly retained in position on the rotary member by retainers as the rotary member is rotated.

20. A combination as set forth in claim 11, at least a portion of the first adhesive being retained on the support portion of each flap.

21. A combination as set forth in claim 1, there being an adhesive on each flap for retaining the abrasive particles on the backing member of such flap, at least a portion of the adhesive on the support portion of each flap being retained on such support portion during the removal of the abrasive particles from such support portion of such flap.

22. A combination as set forth in claim 1 wherein abrasive and compressive sheets of material are disposed between adjacent pairs of flaps in the pack before the support portions of the flaps and the interior portions of the flaps in the pack are compressed.

23. In combination for use in any array for engaging a workpiece, a plurality of abrasive flaps each having first and second parallel surfaces and including a backing member and abrasive particles on the first surface of the backing member, each of the abrasive flaps having a working portion, a support portion and an interior portion extending from the support portion to the end of the flap opposite the working portion, the abrasive particles being removed from some of the flaps only at the support portions of the flaps along the full width of the flaps, the abrasive flaps being compressed against one another at the support portions of the flaps and at the interior portions of the flaps along the full widths of the flaps, and an adhesive material disposed between the flaps at the support portions and the interior portions of the flaps with the abrasive flaps tightly compressed against one another at the support portions of the flaps and at the interior portions of the flaps, the abrasive material being removed from the support portions and the interior portions of others of the flaps along the full widths of such flaps.

24. In combination for engaging a workpiece, a plurality of abrasive packs each formed from a plurality of abrasive flaps, each of the abrasive flaps having a particular width, each of the abrasive flaps in each of the abrasive packs including a backing member having first and second opposite surfaces and having a working portion, a support portion and an interior portion extending from the support portion in a direction opposite to the working portion and each of the abrasive flaps having abrasive particles adhered to the backing member, some of the flaps having abrasive particles removed only from the backing members of such flaps at the support portion along the full width of the support portion, the support portions and the interior portions of the abrasive flaps in each pack being tightly compressed against one another along the full width of the flaps and being adhered to one another in the tightly compressed configuration, and means for retaining the packs in an annular disposition for rotation relative to the workpiece, means coupled to the retaining means for providing for a rotation of the packs and the retaining means, the abrasive material on others of the flaps being removed from the support portions and the interior portions of along the full widths of such flaps.

25. In combination for engaging a workpiece, a plurality of abrasive packs each formed from a plurality of abrasive flaps, each of the abrasive flaps having a particular width, each of the abrasive flaps in each of the abrasive packs including a backing member having first and second opposite surfaces and having a working portion, a support portion and an interior portion extending from the support portion in a direction opposite to the working portion and having abrasive particles adhered to the backing member, some of the flaps having abrasive particles removed only from the backing members of such flaps at the support portion along the full width of the support portion, the support portions and the interior portions of the abrasive flaps in each array being tightly compressed against one another along the full width of the flaps and being adhered to one another in the tightly compressed configuration, and means for retaining the packs in an annular disposition for rotation relative to the workpiece, the abrasive material being removed from the support portions and the interior portions of others of the flaps in the pack along the full widths of such flaps.

* * * * *